United States Patent [19]

Monfort et al.

[11] Patent Number: 4,850,089

[45] Date of Patent: Jul. 25, 1989

[54] SURFACE TREATMENT OF A ROLLING MILL ROLL

[75] Inventors: Guy Monfort, Braives; Jean Crahay, Francorchamps; Adolphe Bragard, Esneux, all of Belgium

[73] Assignee: Centre De Recherches Metallurgiques-Centrum Voor Research In De Metallurgie, Brussels, Belgium

[21] Appl. No.: 935,094

[22] Filed: Nov. 24, 1986

Related U.S. Application Data

[63] Continuation of Ser. No. 797,439, Nov. 13, 1985, abandoned.

[30] Foreign Application Priority Data

Nov. 14, 1984 [BE] Belgium ..... 6/48029

[51] Int. Cl.[4] ..... B21B 1/00; B21B 3/00

[52] U.S. Cl. ..... 29/121.8; 29/121.1; 29/132

[58] Field of Search ..... 29/121.8, 121.1, 129.5, 29/132, DIG. 13, 527.2, 458, 557, 558

[56] References Cited

U.S. PATENT DOCUMENTS

| | | | |
|---|---|---|---|
| 281,596 | 7/1883 | Wilmot | 29/130 |
| 3,177,558 | 4/1965 | Gronholz et al. | 29/121.8 |
| 4,433,032 | 2/1984 | Nakamura et al. | 29/130 |
| 4,507,366 | 3/1985 | Wergiun et al. | 29/129.5 |

FOREIGN PATENT DOCUMENTS

| | | |
|---|---|---|
| 0090428 | 10/1983 | European Pat. Off. . |
| 2086561 | 12/1971 | France . |
| 0002661 | 1/1985 | Japan . |

*Primary Examiner*—Mark Rosenbaum
*Assistant Examiner*—Irene Cuda
*Attorney, Agent, or Firm*—Holman & Stern

[57] ABSTRACT

The surface of a rolling mill roll is coated with a coating comprising a metallic substance and is then marked by means of an intermittent laser beam. As a result, micro-craters are formed which penetrate the roll and which have rims containing components from the roll and the coating. The longevity of the roughness of the roll can thereby be enhanced.

7 Claims, 1 Drawing Sheet

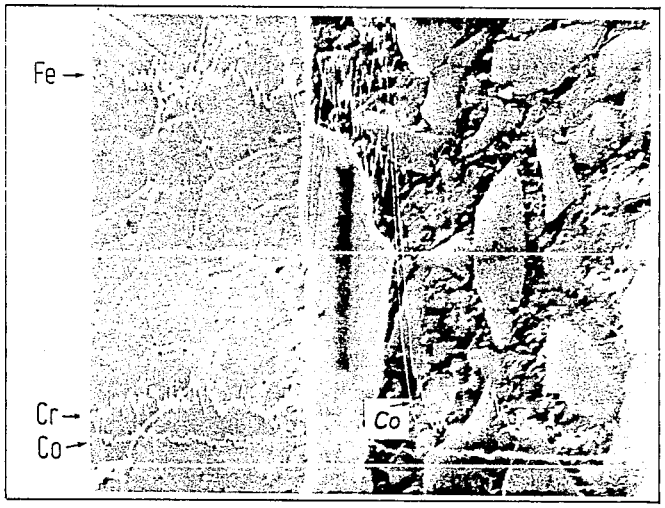
Fe
Cr
Co
Co

SURFACE TREATMENT OF A ROLLING MILL ROLL

This is a continuation of application Ser. No. 797,439, filed Nov. 13, 1985 now abandoned.

BACKGROUND OF THE INVENTION

1. Field of Invention

The present invention relates to rolling mill rolls and to process for the surface treatment of such rolls. It relates more particularly to a process for marking cold strip mill rolls so as to provide steel strip with controlled roughness.

2. Description of Prior Art

A process for marking the surface of a rolling mill roll by means of an intermittent laser beam is already known from a number of prior publications by the assignees of the applicants, in particular their Belgian Pat. No. 870,609. This known process brings about the formation of micro-craters on the surface which are distributed according to a predetermined pattern and which, being impressed into the surface of the steel, provide the required roughness. Very good results have been obtained with rolls treated in this way.

When the roughness has worn away, the rolls have to be reconditioned in order for the surface to return to its original condition. A worn roll has to be removed from the rolling mill, ground, and re-marked, then re-assembled in the rolling mill. These operations and the work and adjustment which they require are costly and this affects the cost of the roll. It would therefore be preferable to increase the period of time between reconditionings, i.e. to decrease the rate of wear of the roughness.

What is desired is a process which allows this objective to be attained.

SUMMARY OF THE INVENTION

The invention is based on the discovery that in the impact zone of the laser beam, the roll surface is the point of localised fusion, forcing back the molten metal towards the edge of this zone. Thus a metal rim which solidifies very quickly is formed around the micro-crater obtained, as a result of the very short duration of the laser pulse which causes it to occur. The said rim is of great importance in forming the controlled roughness of the steel strip rolled by means of the said roll. The applicants have devised original means for increasing the hardness of the rim, taking advantage of its method of formation, and thus for improving the useful life of the roll itself. The process can, incidentally, be used to harden the entire region affected by laser radiation.

To this end, the invention provides a surface treatment process for a rolling mill roll, in which the surface of the said roll is marked by means of an intermittent laser beam, and in which, before the said markings is carried out, a coating which comprises at least in part a metallic substance, is applied to the said surface.

According to a particular embodiment of the process of the invention, a metallic coating comprising nickel, chromium, cobalt, or an alloy of at least two of these metals, is applied to the surface of the roll.

According to another embodiment, a coating comprising at least one metal and at least one metallic oxide is applied to the surface of the roll. The metallic oxide may be derived from a different metal from that which is used in the composition of the coating. It has, however, proved to be advantageous to use an oxide of a metal which is also present in the coating. For example, the presence of nickel oxide associated with nickel increases the amount of energy from the laser beam absorbed by the surface. The result of this is, on the one hand, increased depth of fusion and consequently increased depth of roughness, and on the other hand improved alloying of the metal of the roll with the nickel and greater hardness of the solidified rim.

According to a further embodiment of the process of the invention, a coating or a powder comprising at least one hardening constituent, such as a carbide or a nitride, and/or at least one constituent which reacts with at least one constituent of the material of the said roll to form the said hardening constituent.

The coating may be applied using any method known per se which is appropriate to the coating material used. By way of non-limiting example, known coating methods which can be used include, in particular, electrolysis, electrophoresis, vapor deposition, or ion implantation. A powder may also be deposited using a suitable method.

From the characteristics which have just been discussed, it can be seen that, in the case of the invention, the coating applied to the surface of the said roll advantageously comprises a substance, or at least one component, which can be alloyed with the locally melted material of the roll and/or can react with at least one of the components of the said material.

In these conditions, the above-mentioned hardening effect which results from the alloying or reaction is localised substantially in the rims which surround the micro craters, i.e. in those regions which are used for impressing the roughness into the laminated steel via the said roll. This embodiment therefore provides maximum efficiency of the process of the invention.

BRIEF DESCRIPTION OF THE DRAWING

The invention will be described further, by way of example, with reference to the accompanying drawing, whose sole FIGURE is a photomicrograph of a section of the surface of a rolling mill roll treated by a process according to the invention.

EXAMPLE

The process of the invention is illustrated, by way of example, as applied to a rolling mill roll made of steel of conventional composition.

When the roll has been temper-hardened by induction until a hardness of 720 Vickers is reached, a layer of cobalt 5 μm thick is electrodeposited on the roll followed by a layer of chromium 1 μm thick.

The surface thus coated is then treated using a 1 kW laser, so as to form a roughness $R_a$ of between 4 and 5 μm. The craters formed are quite separate from one another.

Under these conditions, craters were formed with a rim comprising an alloy containing a high proportion of cobalt, the height of which is of the order of 10 to 15 μm.

The FIGURE illustrates a cross-section of one of the said rims, photographed with an enlargement X 2000 using a scanning electron microscope.

In the photograph, the mounting resin is on the right, the highly alloyed metal rim is in the centre and the metal of the roll on the left (the roll was prepared by nital etching for the micrographic examination).

It is possible to determine by X-ray analysis the proportion of the different metals comprising the said rim. In addition to iron, cobalt, and chromium, whose contents are superimposed graphically on the photomicrograph, relatively small proportions of the alloy elements of the steel of the roll can be found in the rim.

Under laboratory conditions, the approximate contents of iron, cobalt, and chromium in the rim were determined as, respectively, 6%, 85%, and 9%, by weight.

We claim:

1. In a method for the surface treatment of a rolling mill roll, including depositing on the roll surface a layer of a material which is at least partly metallic, directing an intermittent laser beam at the surface of said layer while rotating said roll about its longitudinal axis, melting the layer surface in each successive impact zone of the laser beam, forming in said impact zone a microcrater surrounded by a rim and solidifying the rim, the successive microcraters being distributed according to a determined pattern in order to impart a controlled roughness to said surface, the improvement comprising providing the material of said layer with at least one hardening component or at least one component which can react with at least one constituent of the material of said roll to form said hardening component, melting also the material of said roll surface in the successive impact areas of the laser beam, alloying said molten roll material with said molten layer material in said impact areas, and forming an alloyed rim around each of said microcraters.

2. The method of claim 1 wherein said hardening component is a carbide or a nitride.

3. The method of claim 1 wherein said roll is a roll for a cold rolling mill.

4. The process of claim 1, in which the metallic substance is selected from the group consisting of nickel, chromium, cobalt, and alloys of at least two of these metals.

5. The process of claim 1, in which the coating comprises at least one metallic oxide.

6. The process of claim 5, in which the coating comprises a metal and an oxide of the metal.

7. The process of claim 1, in which the coating is applied in a plurality of layers.

* * * * *